US005443184A

United States Patent [19]

Broitzman

[11] Patent Number: 5,443,184

[45] **Date of Patent: * Aug. 22, 1995**

[54] FLUID POURING CONTAINER WITH ASYMMETRICAL SOLIDS SEPARATOR

[76] Inventor: Stephen K. Broitzman, P.O. Box 5992, Snowmass Village, Colo. 81615

[ * ] Notice: The portion of the term of this patent subsequent to Sep. 21, 2010 has been disclaimed.

[21] Appl. No.: 123,781

[22] Filed: Sep. 20, 1993

[51] Int. Cl.[6] ..... B67D 5/58

[52] U.S. Cl. ..... 222/189.07; 209/352; 222/465.1; 222/572; 222/575

[58] Field of Search ..... 222/189, 465.1, 475.1, 222/566, 572, 575; 209/17, 260, 352

[56] References Cited

U.S. PATENT DOCUMENTS

| | | | |
|---|---|---|---|
| D. 252,846 | 7/1979 | Miller | D7/64 |
| 1,145,422 | 7/1915 | Jones | 222/465.1 |
| 2,006,704 | 7/1935 | Van Muffling | 222/572 X |
| 2,753,049 | 7/1956 | Gaines et al. | 222/189 X |
| 2,840,239 | 6/1958 | Wethammer | 222/189 X |
| 3,809,290 | 10/1972 | Schmit | 222/88 |
| 4,403,709 | 5/1980 | Meins et al. | 220/90.4 |
| 4,492,323 | 11/1985 | Essen | 222/556 X |
| 4,655,373 | 5/1984 | Essen | 222/465.1 |
| 4,957,224 | 9/1989 | Kessler et al. | 222/465.1 |
| 5,246,149 | 9/1993 | Broitzman | 222/575 X |
| 5,275,307 | 1/1994 | Freese | 222/189 X |

FOREIGN PATENT DOCUMENTS

| | | | |
|---|---|---|---|
| 803645 | 7/1936 | France | 222/572 |
| 18463 | of 1905 | United Kingdom | 222/189 |
| 269306 | 4/1927 | United Kingdom | 222/189 |
| 276083 | 8/1927 | United Kingdom | 222/189 |
| 695608 | 8/1953 | United Kingdom | 222/572 |

OTHER PUBLICATIONS

Cambro Mfg. Ad in Food Service Product News, Jan, 1993, Circle 296 Reader Service Card.

*Primary Examiner*—Andres Kashnikow
*Assistant Examiner*—Joseph A. Kaufman

[57] ABSTRACT

An asymmetrical ice dam has a half dome projecting inwardly from the upper rim of a water pitcher. A strainer projects down from the major lip. These two members form a major lip. A spout projects outward from the upper rim of the container adjacent the strainer. A minor lip projects inwardly from the upper rim of the water pitcher adjacent the spout. The server can precisely control the flow of ice by rotating the major lip/strainer combination away from its vertical axis. A cooking container embodiment is also disclosed.

20 Claims, 12 Drawing Sheets

FIG. 1A
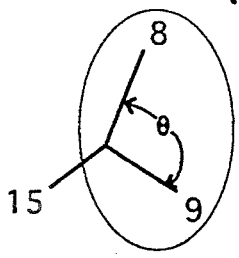
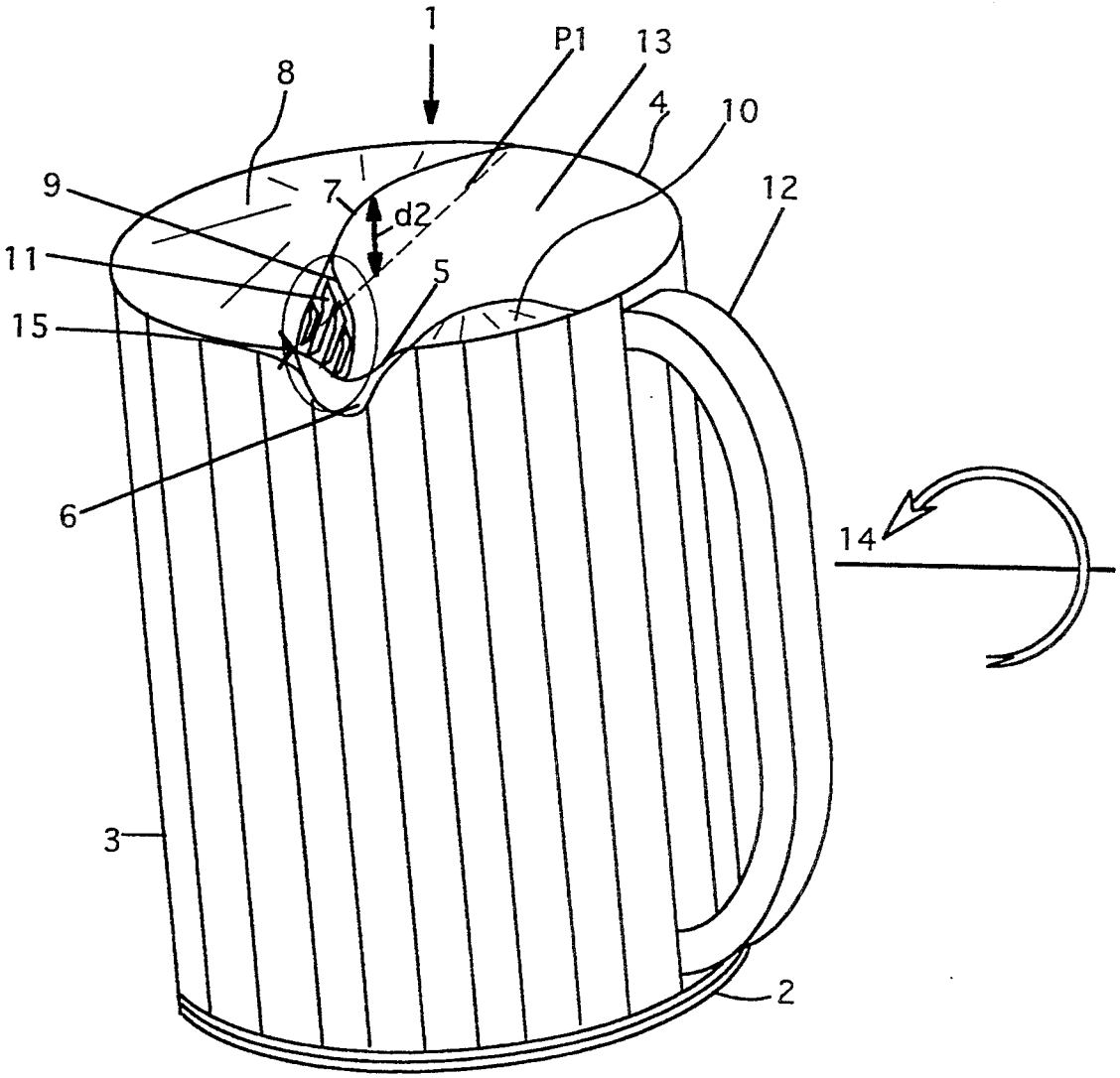
FIG. 1

FLUID POURING CONTAINER WITH ASYMMETRICAL SOLIDS SEPARATOR

CROSS REFERENCE PATENTS

U.S. application Ser. No. 07/920,243 allowed as U.S. Pat. No. 5,246,149 is incorporated herein by reference.

FIELD OF THE INVENTION

The present invention relates to pouring containers including beverage pitchers and receptacles having lids such as cooking utensils. The invention encompasses any and all containers that are designed to pour a liquid and solids contained therein (such as ice) simultaneously and with control as to the amount of solids poured. The invention can be used in other vessels including buckets, large loading containers (vats and drums), beakers, carafes and measuring containers, and serving utensils.

BACKGROUND OF THE INVENTION

It is known that the most common type of beverage pitcher has a symmetrical ice dam on the top. The standard beverage pitcher has a spout with ice dam configured like two clam shells extending inwardly and slightly upwardly from the top circular rim of the container. In operation during pouring of liquid with ice between the two ice dam halves, the ice can accumulate during dispensation therefore creating a blockage behind the ice dam halves, resulting in a turbulent flow of the liquid without the desired ice. The liquid and ice is then poured from the side of the conventional beverage pitcher. A server generally prefers to pour the desired liquid and solids from a 90° angle from the handle as this method allows free flow of the liquid and solids, provides better visibility of the activity and naturally accommodates the most ergonomically correct utility of arm, wrist and hand, reducing the instance of Cumulative Trauma Disorder.

An improved embodiment of the conventional beverage pitcher is disclosed in U.S. Pat. No. 4,957,224 (1990) to Kessler et al. Kessler discloses a multi-spouted water pitcher. The primary spout has an ice dam which totally blocks all the ice. A secondary spout is made of a symmetrical ice dam on the side of the water pitcher. This ice dam allows some ice to flow with the water. However, there is no way to control how much ice will flow past the symmetrical halves of the ice dam. A certain ice flow will occur based on the size of the ice cubes.

U.K. Pat. No. 695,608 (1953) to Freed discloses a spout or lip on a container for dispensing liquids (not solids mixed therein). The sole purpose of the spout or lip is to prevent dripping. The spout is asymmetric (that it projects asymmetrically from the rim of the container) and works in combination with a depression in the wall of the container which serves as a channel. The asymmetric spout naturally projects at an acute angle to one side of the container. The spout is also preferably twisted downward as well as sideways. The channeling forms a hump on the inside of the container. No ice dam whatsoever is taught by Freed. Freed's invention may cause the ice in his container to slice to the right or left. However, the ice will never be blocked by Freed's bent spout.

In the present invention the ice dam is comprised of a major lip and a minor lip which project inwardly from the upper edge of the container. Thus, it is the ice dam that is asymmetrical, not the spout. Therefore, Freed describes a totally different structure and teaches a totally different purpose than the present invention.

Passaquay's French patent number 803,645 was published in 1936. Passaquay discloses an ice stopper (ice dam) for a pitcher. He teaches that the closest art is a removable grill put on top of pitchers. Passaquay's invention is a pair of spout members (c) pushed together to form a narrow channel (d) which only allows liquid to pass. Ice cubes are totally blocked by the spout members (c). No ice dam is taught which faces inwardly nor upwardly from the upper edge of the container. Thus, Passaquay only teaches the total restraint of ice pouring from a pitcher wherein the pitcher has a spout which serves as an ice dam. The present invention does not require any spout at all. It is clear that ice could be poured from either side of the pitcher in Passaquay just like the conventional ice water pitchers in use today which all have symmetrical ice dams. Therefore, Passaquay teaches an ice dam with the typical all or nothing control of ice.

The present invention allows the user to regulate how much ice he wants poured into each glass. The pourer changes the rotational angle of the pitcher in order to controllably block the ice with the larger lip of the asymmetrical ice dam.

Some water pitchers (offered by Cambro Mfg. Co., P.O. Box 2000, Huntington Beach, Calif. 92647-2000, as seen in the Foodservice Product News, January 1993 edition, Circle 296 Reader Service Card) use a removable top. The covered pitcher has a three way cover. The first position is closed for storage. The second position is slotted to allow the flow of liquid. A third position allows the controlled flow of ice and water. This invention requires a two hand operation. It is also made of an expensive two piece construction.

In summary, the applicant has invented the first container which provides for the modulated, controlled flow of ice and water through a single pouring spout. The heart of the invention is an asymmetrical ice dam which incorporates a filter that allows the water to be dispensed while ice is dammed. The present invention is used with one hand to rapidly dispense liquid and a controlled amount of ice with laminar flow. The present invention avoids a surprise splash caused by a rush of ice bursting over the side of a conventional water pitcher.

SUMMARY OF THE INVENTION

The main object of the present invention is to provide a water pitcher having an asymmetrical ice dam projecting inwardly and upwardly from the top rim. A larger major lip of the ice dam has two members. The first member is a semi-circular permanent cover over the top of the water pitcher. The second member is a downward projecting slotted extension of the first member which positively blocks ice while allowing water to flow through the slots. This embodiment allows the controllable flow of ice even with a large amount of ice in the water pitcher. The rate of flow of the ice is controlled by rotating the central axis of the water pitcher.

Another object of the present invention is to provide a smaller minor lip opposite the pouring spout to allow the controllable flow of water and/or ice out the spout.

Another object of the present invention is to provide a water pitcher of the above description but with an additional non-dirt collecting design which enables the water pitcher to be disinfected, rinsed and filled with ice without manual scrubbing.

Another object of the present invention is to provide a pot having a lid wherein all of the above objects are incorporated. This alternate embodiment allows a pot containing for example clam chowder to controllably pour an exact amount of solid particles out with the liquid.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 1 is a top perspective view of a water pitcher having an asymmetrical ice dam.

FIG. 6(*b*) is a top perspective view of the water pitcher of FIG. 6(*a*) immersed next in a rinse water bath.

FIG. 6(*c*) is a top perspective view of the water pitcher of FIG. 6(*b*) next scooping up ice from an ice container.

FIG. 6(*d*) is a top perspective view of the water pitcher of FIG. 6(*c*) next filling up with water.

Figure 2:
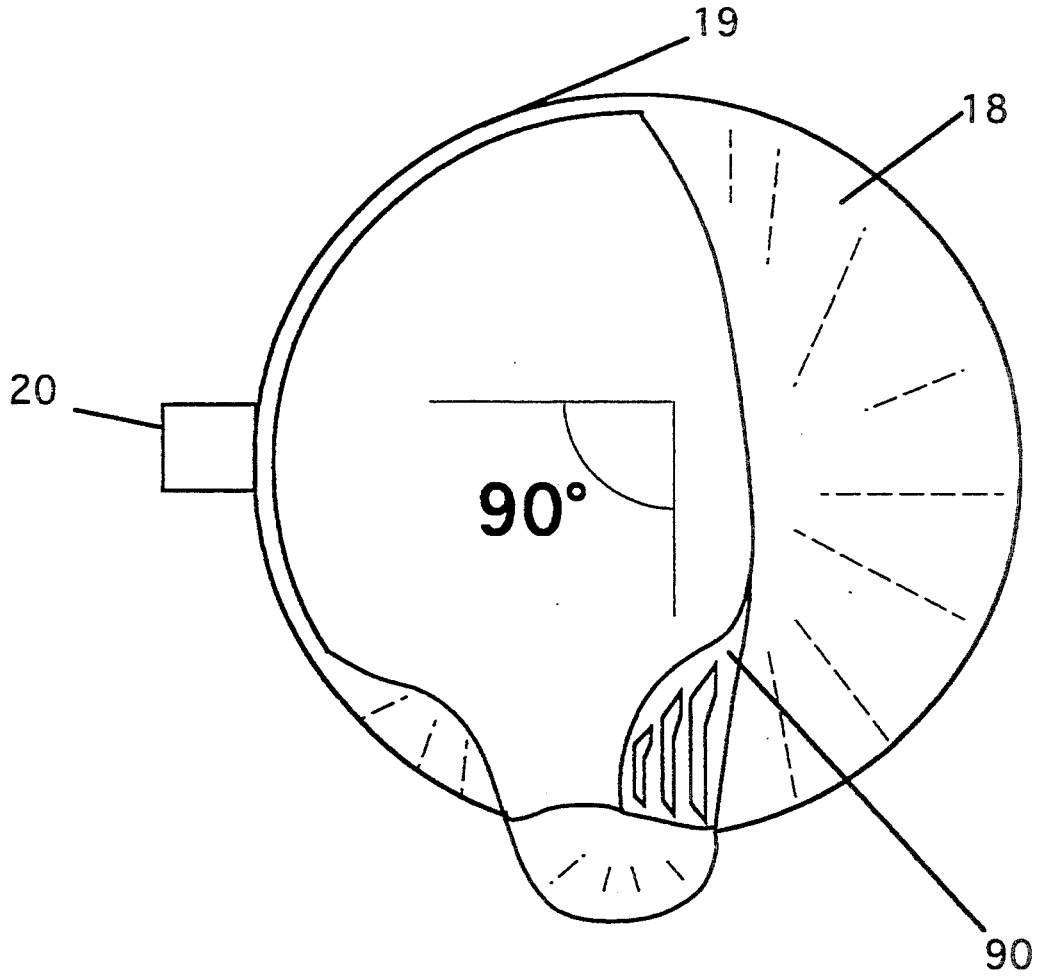
FIG. 2 is a top plan view of a water pitcher with a handle on the left side for left handed users.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Referring first to FIG. 1 a water pitcher 1 has a circular bottom 2 and a cylindrical body 3. The top rim 4 is substantially circular except for the portion of the rim 5 which attaches to the spout 6. Line pl represents the diameter (5 inches) of the rim 4. The distance d2 ($1\frac{1}{4}$ inches) represents the height of the center 7 of major lip 8 above the rim 4. It would be an obvious design choice to use a non-cylindrical shape for the water pitcher.

Major lip 8 has a strainer 9. Major lip 8 in combination with minor lip 10 comprise an asymmetrical ice dam assembly 8,9,10.

Major lip 8 extends across-approximately $\frac{1}{2}$ of the circular area defined by rim 4. Design choices could vary the size of major lip 8.

Strainer 9 blocks ice but allows water to flow through slots 11. FIG. 1 shows four slots denoted by the number 11. However, the number as well as the size of slots 11 are a matter of design choice. Also slots 11 could be circular holes or any variety of orifices. The designer need only choose the desired rate at which he wishes the water to flow through the orifices. Naturally any liquid such as tea could be substituted for the water.

Grasping means in the form of a handle 12 is shown. An alternative grasping means (not shown) would include but not be limited to hand indentations in the cylindrical body 3. A flask (not shown) would be another design choice. In order to pour the water out of the open top 13 and out the spout 6, the water pitcher 1 is rotated counter-clockwise (bottom 2 up) as indicated by arrow 14.

It is important to avoid bacteria build up at inside pocket 15. Therefore, the angle Θ between the strainer 9 and the major lip 8 should be obtuse.

Referring next to FIG. 2 a left handed embodiment is shown. The handle 20 is opposite the strainer 90. Rotating handle 20 clockwise raises the strainer 90 and blocks the ice flow. It has been found that raising the user's wrist during pouring is the preferred motion.

Figure 3:
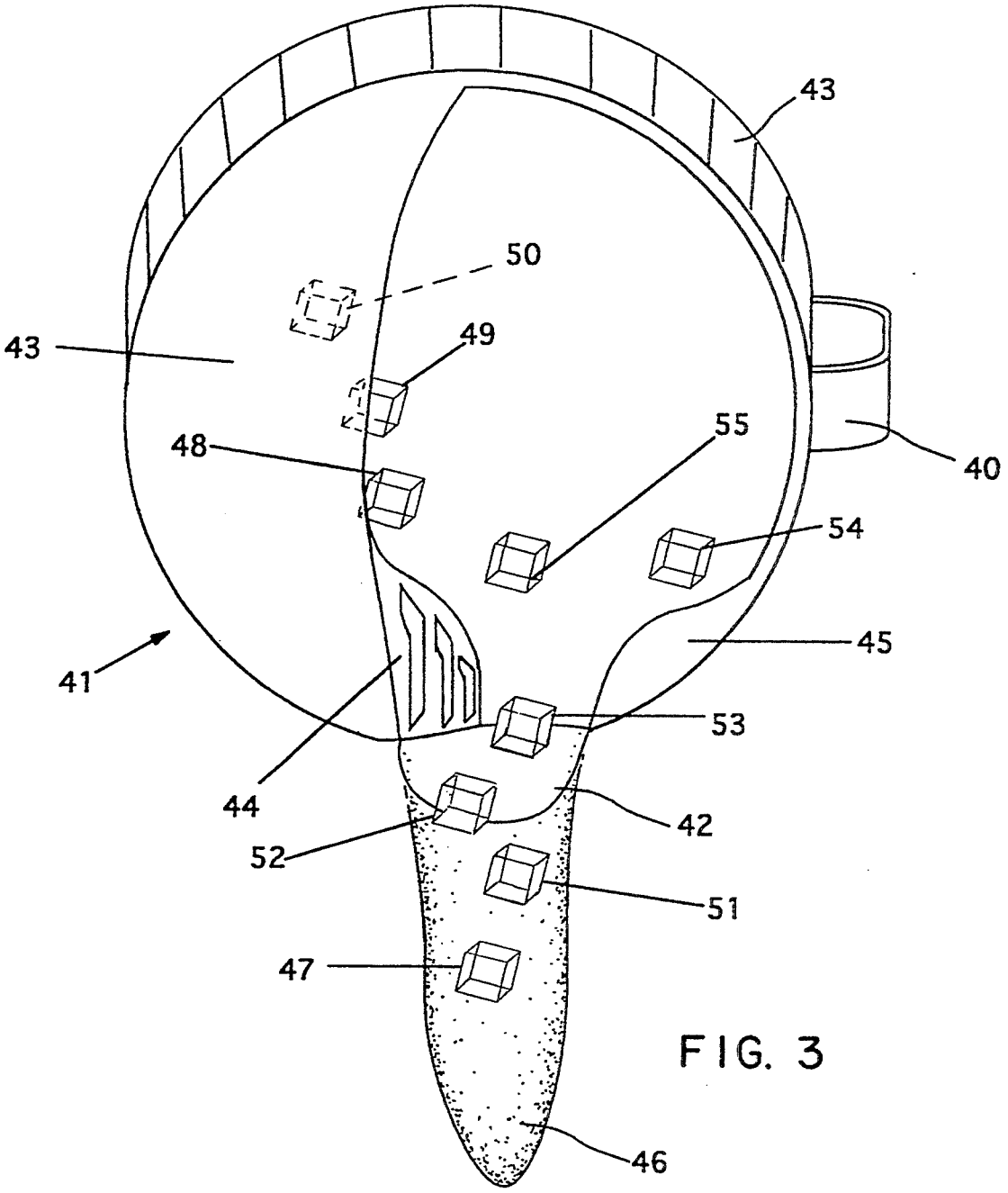
FIG. 3 is a top plan view of a water pitcher (similar to that shown in FIG. 1) during pouring when the asymmetrical ice dam is partially blocking the ice flow.
Figure 4:
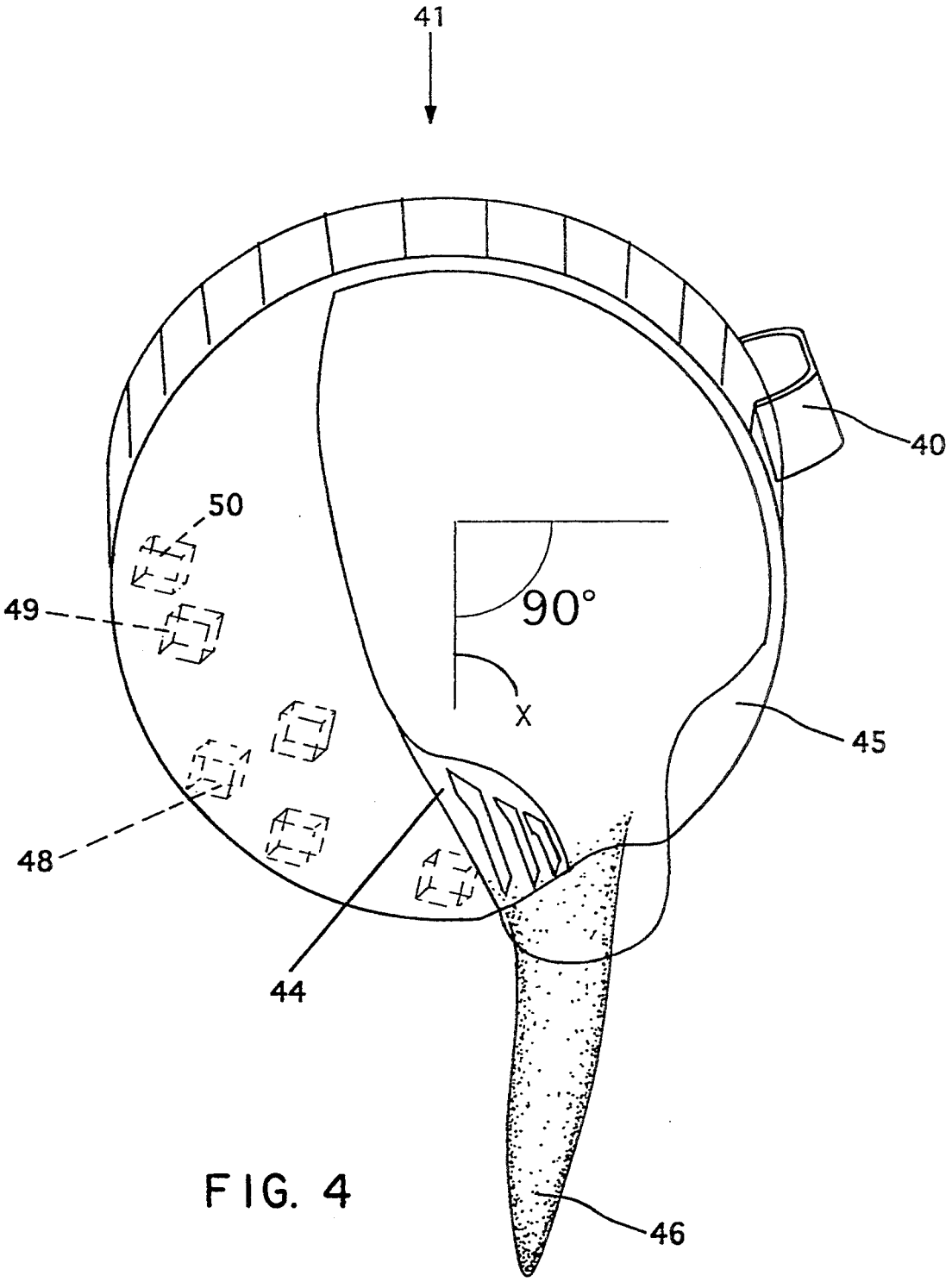
FIG. 4 is the same view as FIG. 3 with the water pitcher rotated counter-clockwise, thereby causing the asymmetrical ice dam to totally block the ice flow.
Figure 5:
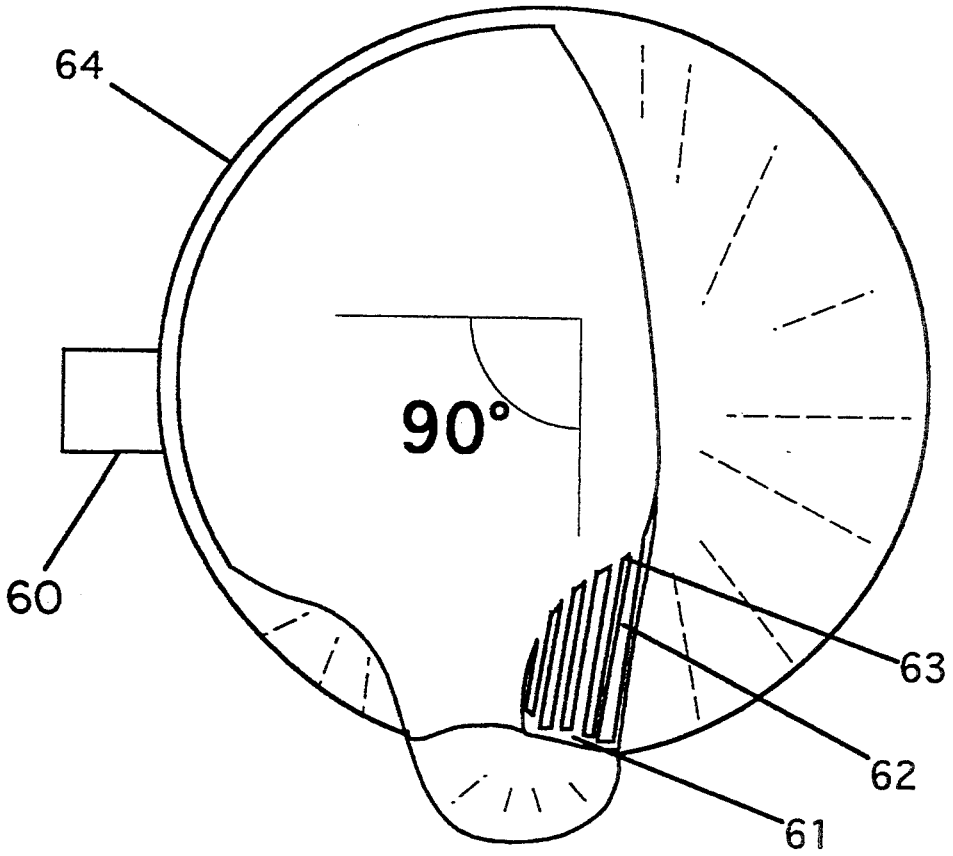
FIG. 5 is a top plan view of an alternate embodiment of a water pitcher having an asymmetrical ice dam.
Figure 6A:
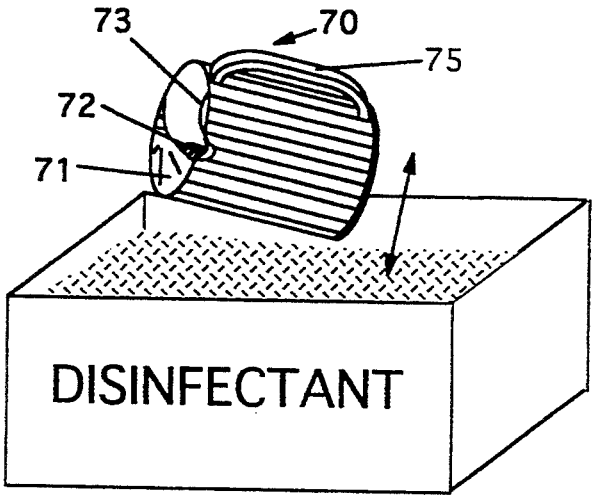
FIG. 6(*a*) is a top perspective view of a water pitcher having an asymmetrical ice dam about to be immersed in a disinfectant bath.
Figure 6B:
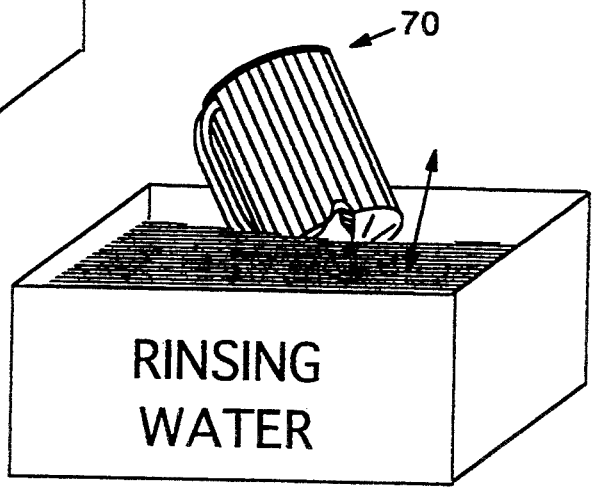
Figure 6C:
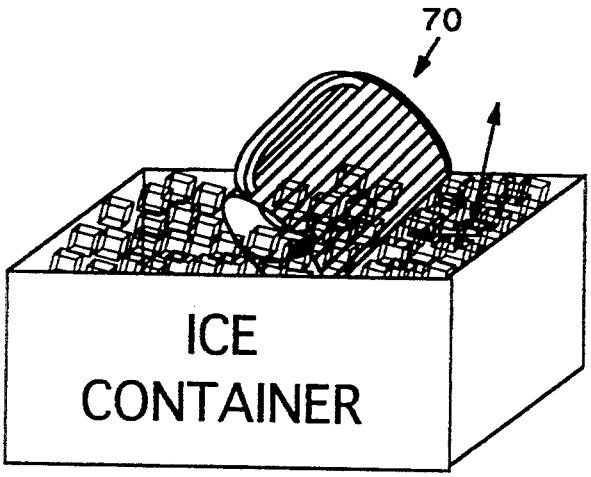
Figure 6D:
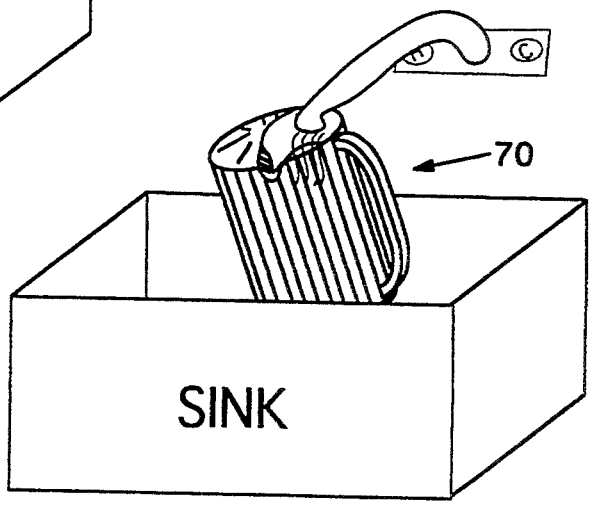
Figure 7:
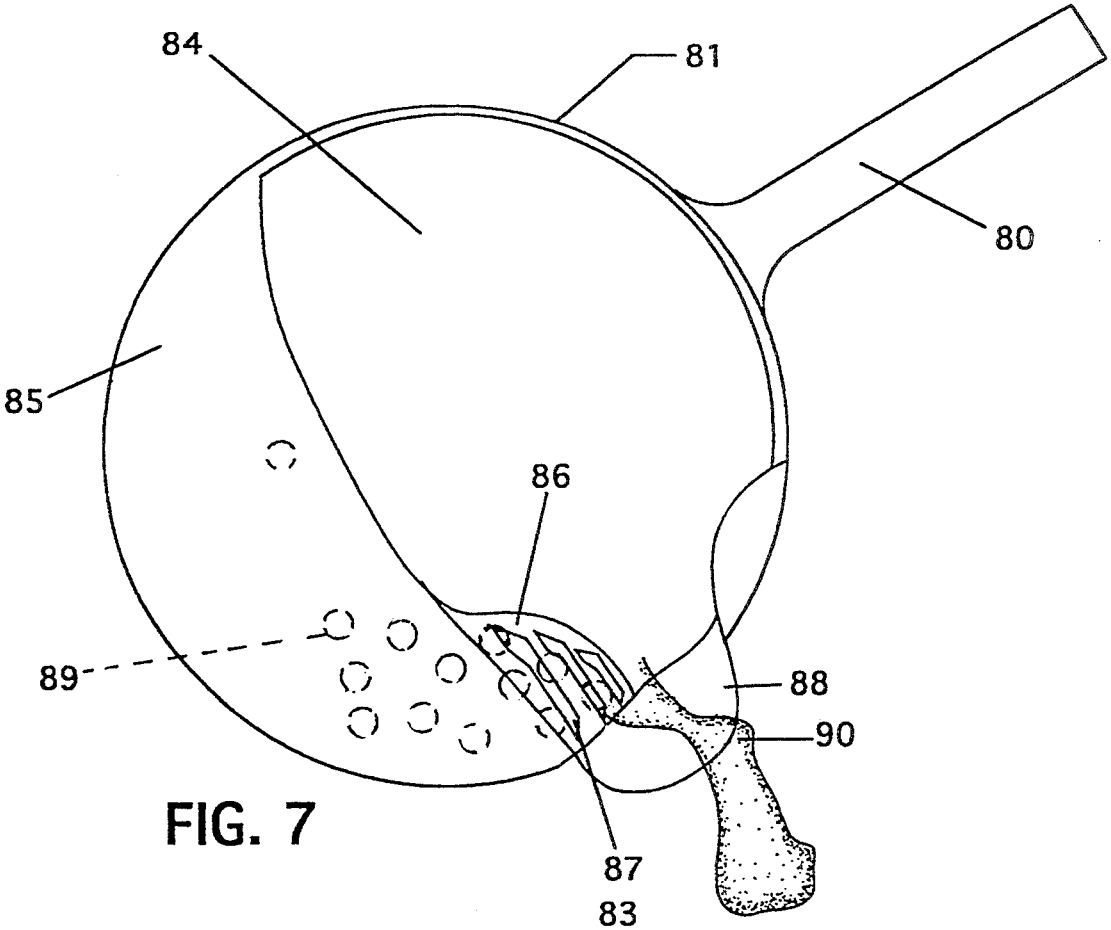
FIG. 7 is a top plan view of a pot having an asymmetrical pouring dam.

The method of operation of all embodiments of the present invention is to rotate the grasping means (handle 12 of FIG. 1; handle 20 of FIG. 2; handle 40 of FIGS. 3,4; handle 60 of FIG. 5; handle 75 of FIGS. 6(*a–d*); handle 80 of FIG. 7. By rotating the grasping means while pouring the user can position the major lip having a strainer and block the desired amount of ice. There are left and right handed persons. Also individual preferences vary as to the most comfortable wrist and arm motion to rotate the grasping means. Therefore, the location as well as the type of the grasping means is a matter of design choice.

Referring next to FIG. 3 a water pitcher 41 has a cylindrical body 43. A handle 40 is shown disposed at a 90° angle to the spout 42. The major lip 43 having strainer 44 is partially blocking the flow of ice 47. Specifically ice cubes 48, 49, 50 are blocked by the major lip 43 and strainer 44. Concurrently water 46 is flowing through strainer 44. Some water along with ice cubes 47, 51, 52, 53, 54, 55 are flowing around strainer 44. The amount of ice cubes which are allowed to flow around strainer 44 is controlled by how far counterclockwise the strainer 44 is rotated. Minor lip 45 directs all flow into spout 42.

In FIG. 4 the strainer 44 is rotated about 20° counterclockwise relative to its position in FIG. 3. The preferred method to rotate the water pitcher 41 is by raising the elbow rather than by rotating the wrist. All of the ice cubes 48, 49, 50 etc. are trapped behind the major lip 43 and strainer 44. Thus, the asymmetrical ice dam comprising assembly 43, 44, 45 provides for the controllable rate of ice flow with water 46 by rotating the assembly away from its perpendicular vertical axis X.

Referring next to FIG. 5 an alternate embodiment of a strainer 61 is shown. It comprises slots 62 etc. made up of prongs 63 etc. Prongs 63 etc. would be subject to breaking when the water pitcher 64 is used to scoop up ice or when it is hand washed by a cloth.

FIGS. 6(*a–d*) illustrate the conventional steps of cleaning and filling the ice pitcher 70. It can be seen that no hand washing is used. Therefore, it is important that the asymmetrical ice dam assembly 71, 72, 73 has a design which avoids dirt build up. See angle Θ in FIG. 1. Also, it is important that the asymmetrical ice dam assembly 71, 72, 73 be structurally strong enough to act as a scoop for ice as shown in FIG. 6*c*.

Figure 8:
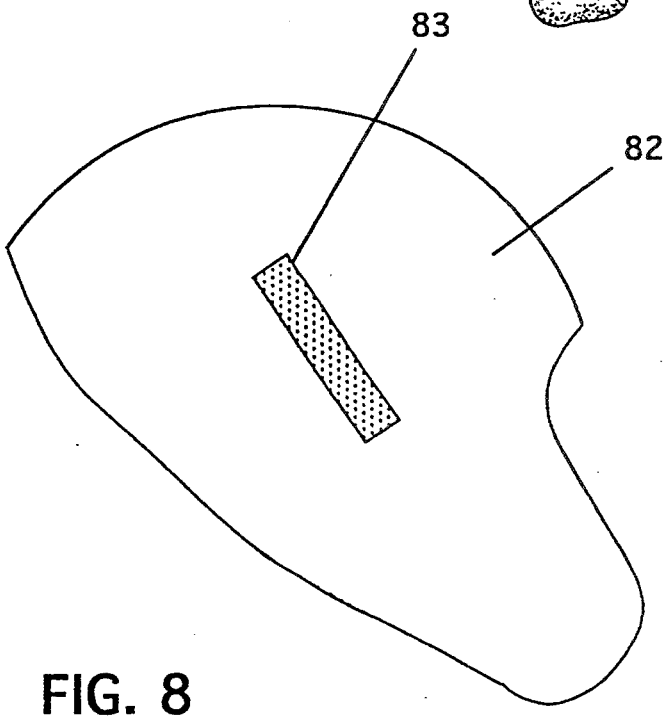
FIG. 8 is a top perspective view of a lid for the pot of FIG. 7.

Referring last to FIGS. 7,8 a pot 81 has a handle 80 and a lid 82. Lid 82 has a handle 83. Lid 82 fits over space 84 during cooking. The pot 81 is shown in the pouring operation in FIG. 7.

An asymmetrical dam assembly comprises a major lip 85 and a strainer 86. The strainer 86 has slots 87. As shown in operation in FIG. 7 the solid particles 89 etc. are held back behind the strainer 86 while the liquid 90 flows through the slots 87 and over the spout 88. An optional minor lip (not shown) could be added to the pot 81. The pot 81 could be any cooking container. The teaching of the present invention is centered on the major lip/strainer combination. The spirit of the invention can be applied to any container used for pouring a liquid containing solid particles.

Figure 9:
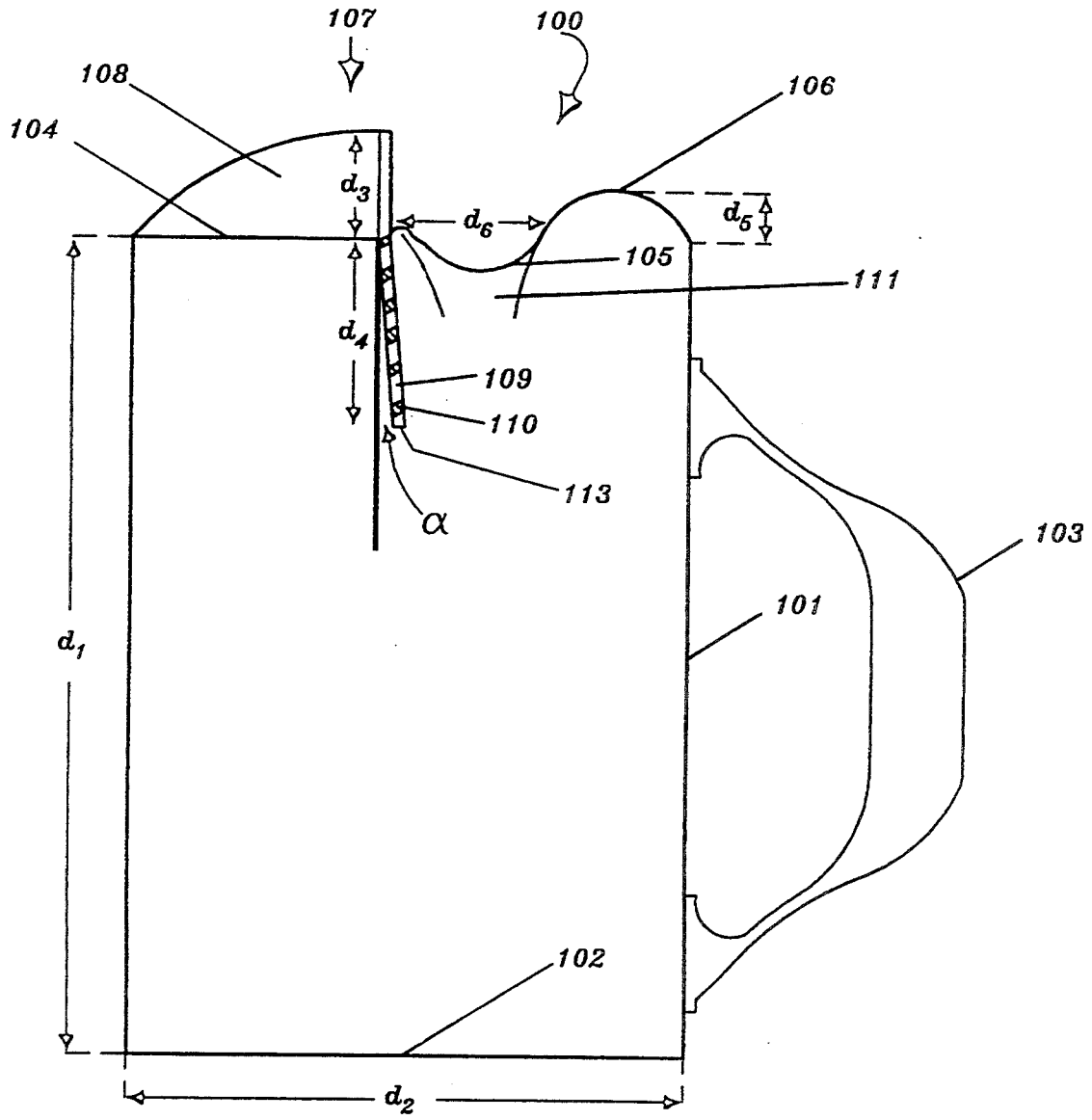
FIG. 9 is a front plan view of another embodiment of a water pitcher having an asymmetrical ice dam wherein the major lip has a large downward depending strainer.
Figure 11:
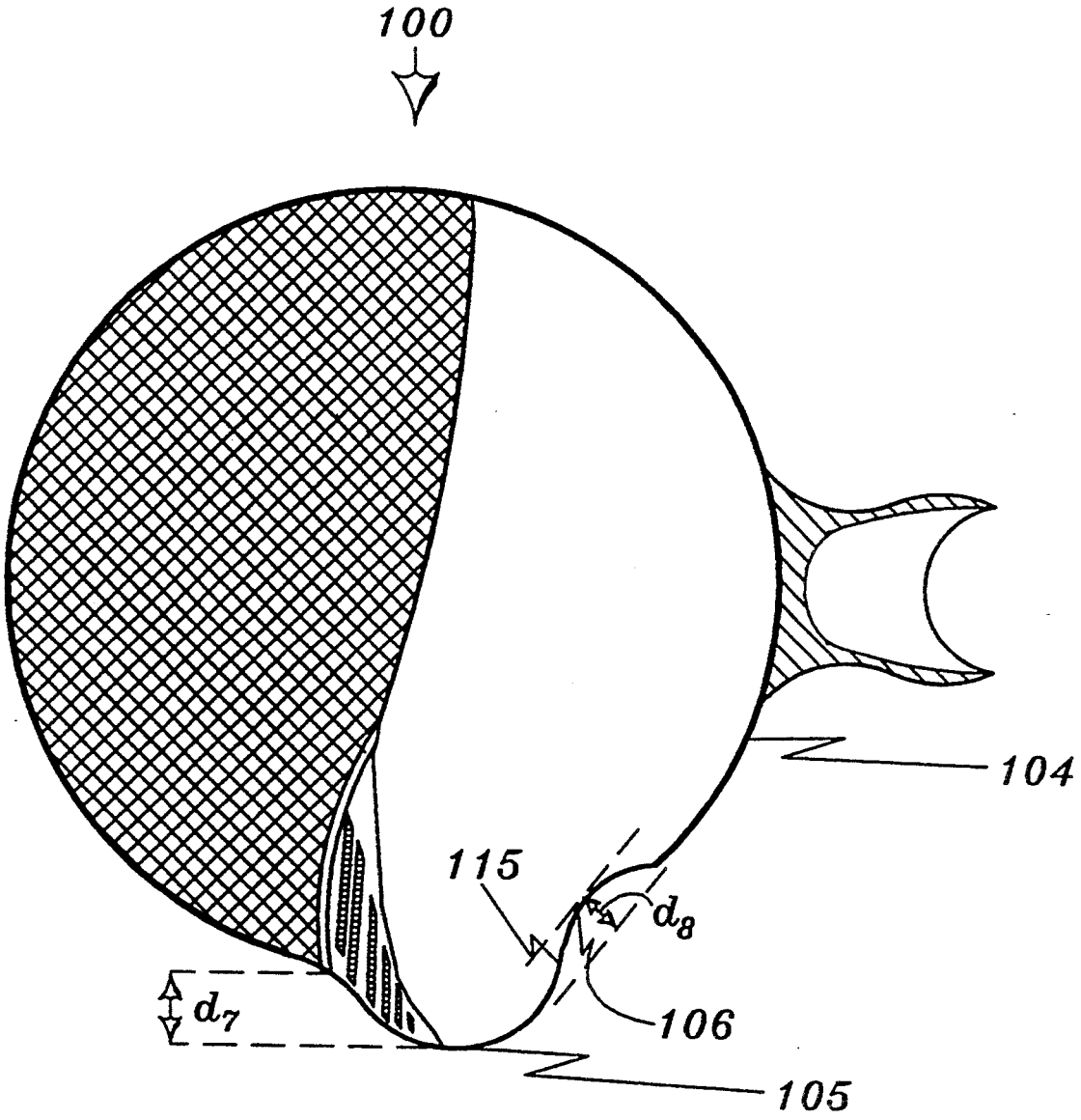
FIG. 11 is a top plan view of the pitcher of FIG. 9.

Referring next to FIG. 9 a water pitcher 100 has a cylindrical retaining wall 101 and a circular base 102. The handle 103 provides a grasping means. An upper rim 104 is generally circular except for the spout 105 and the minor lip 106. The major lip 107 is comprised of the half dome 108 and the strainer 109. Strainer 109 depends a distance d4=$2\frac{1}{4}$" from the rim 104. Angle $\alpha=5°$. Strainer 109 has six slots 110 etc. The spout 105 has a throat 111 which protrudes out from cylindrical retaining wall 101 a distance d7 of $\frac{3}{8}$" (FIG. 11). The summary of dimensions are as follows:

d1=9"
d2=5"
d3=$1\frac{1}{4}$"
d4=$2\frac{1}{4}$"
d5=$\frac{3}{4}$"
d6=$1\frac{1}{4}$"
d7=$\frac{3}{8}$"
d8=$\frac{1}{4}$"
$\alpha=5°$
width of slot 110=1/16"

The water pitcher 100 should not be filled with ice water above the lowermost edge 113 of the strainer 109. The volume of the container below edge 113 is the normal 60 ounces for a water pitcher. Naturally design choices could vary all the dimensions. d3 can be made larger to accommodate larger amounts of ice. The present dimensions provide for a laminar flow as opposed to a turbulent flow.

Figure 10:
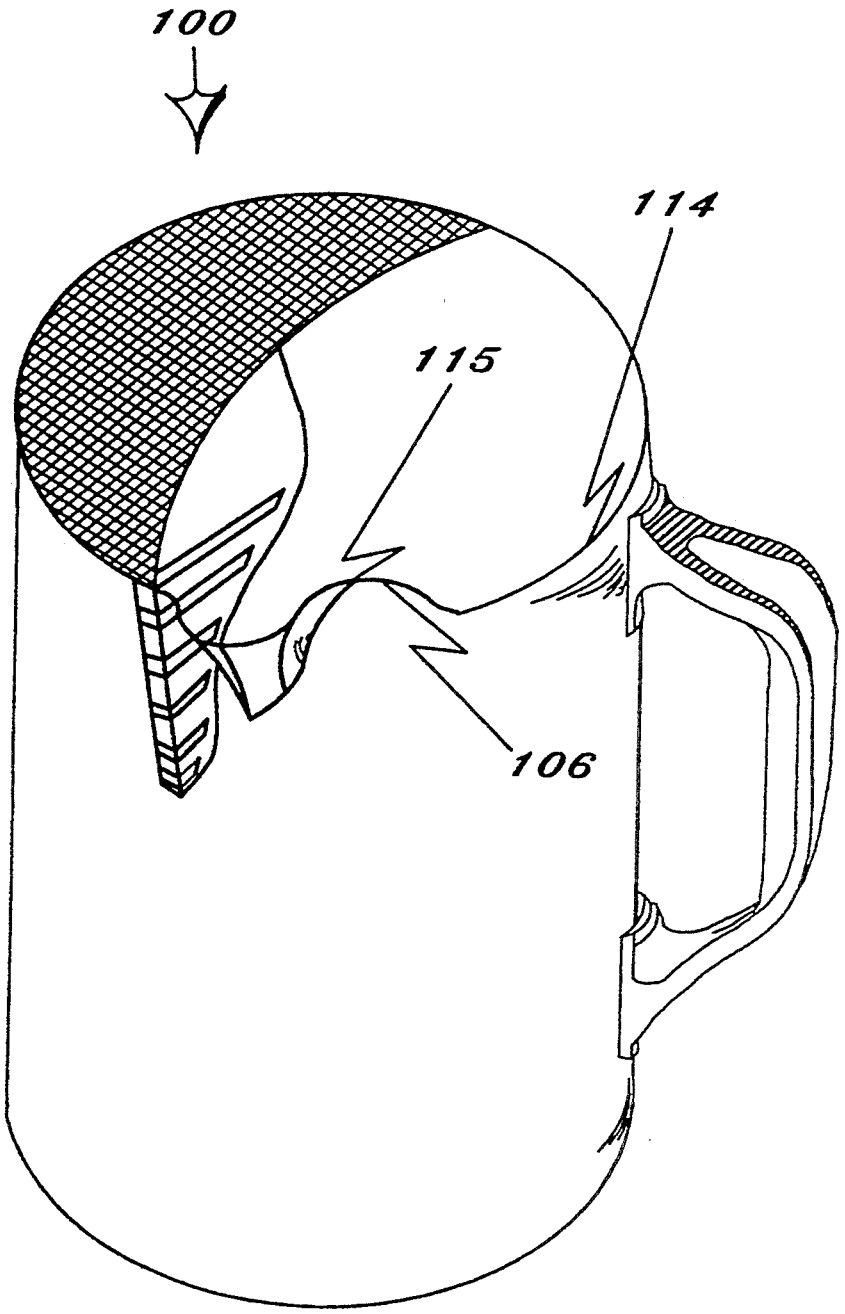
FIG. 10 is a top perspective view of the pitcher of FIG. 9.

Referring next to FIG. 10 the water pitcher 100 has a rim portion 114 which allows big frozen clumps of ice cubes to be poured therefrom. It can be seen that the minor lip 106 begins precisely where the spout ends at point 115.

Referring next to FIG. 11 the minor lip 106 curves inward from rim 104 approximately a distance d8=$\frac{1}{4}$".

Figure 12:
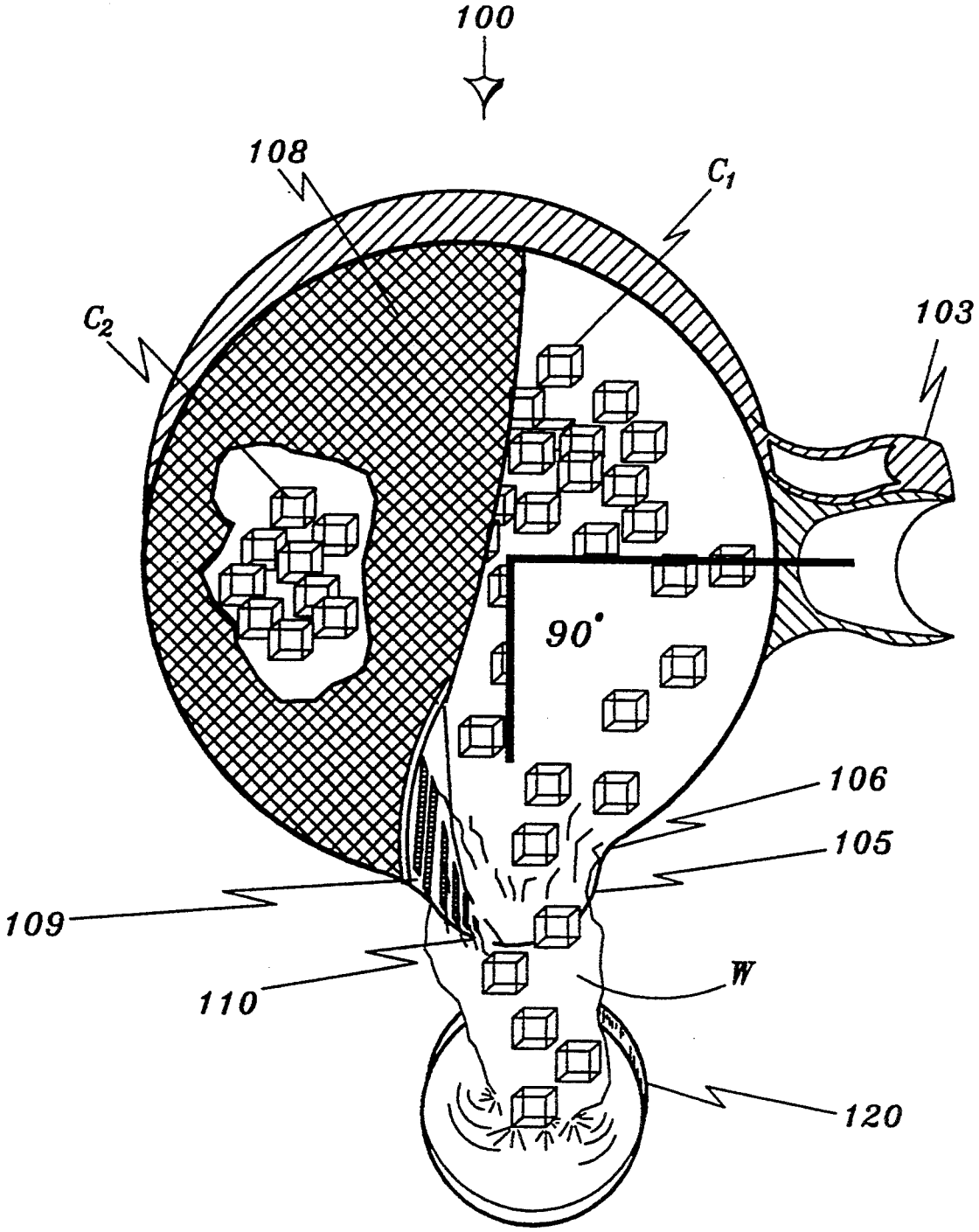
FIG. 12 is a top perspective view of the pitcher of FIG. 9 in the process of pouring ice and water.

Referring next to FIG. 12 the water pitcher 100 is shown in operation. Initially the handle 103 is at a 90° angle to the spout 105 which is perpendicular to the horizontal. A predetermined burst of ice cubes from group C1 along with water W flows out the spout 105 between the strainer 109 and the minor lip 106. The choice of width d6 of spout 105 in combination with the choice of size of ice cubes C1, C2 determines how many initial ice cubes will flow from the spout 105.

Figure 13:
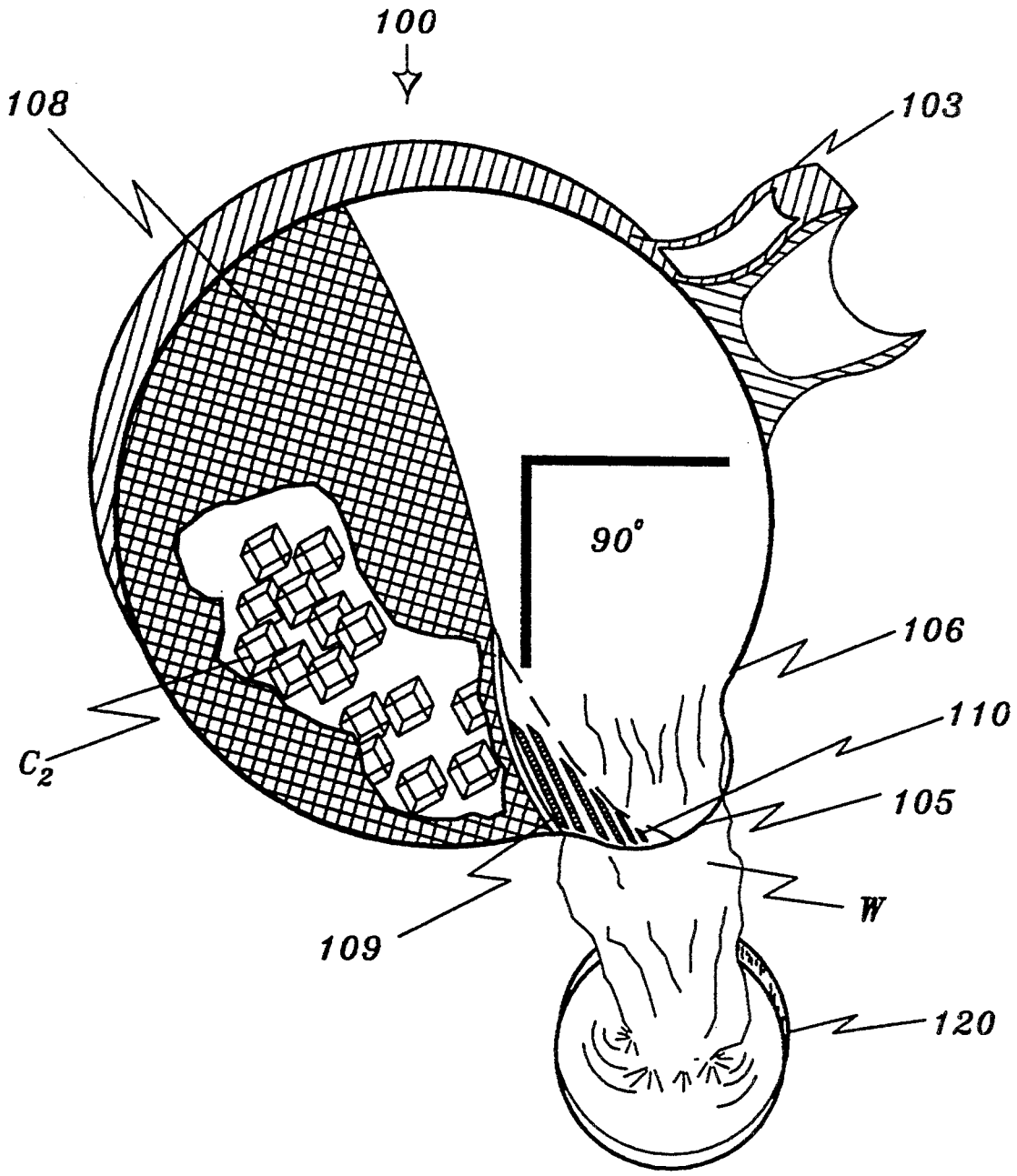
FIG. 13 is a top perspective view of the pitcher of FIG. 12 rotated so as to only allow water to flow.

The user can control how many ice cubes flow out the spout 105 by raising the handle 103 as shown in FIG. 13. FIG. 13 shows the handle 103 raised about 20° above the horizontal, thereby causing the major lip 108, 109 to dam all the ice cubes into group C2. Only water W is allowed to flow in a laminar manner out the slots 110 etc. and down the spout 105 as directed by minor lip 106. The user can rotate handle 103 up and down as desired during the pouring operation to obtain the desired amount of ice cubes in the glass 120.

The pot 81 of FIGS. 7, 8 is made of metal. The most suitable materials for all the water pitchers are nontoxic to humans, relatively rigid and easily sanitized. Such materials preferably comply with the regulation of the Food Additives Amendment of 1958 in the Federal Food, Drug and Cosmetic Act as suitable for use with potable food products. Exemplary materials that are sanitizable include glass, synthetic resin plastic, aluminum, stainless steel, ceramics and the like.

Particularly preferred is moldable plastic material, such as polypropylene, polyethylene, polyvinyl chloride, polyethylene terephthalate (PET), acrylic plastic, polycarbonate and the like.

A pitcher of this invention can be constructed by generally known manufacturing operations, such as blow molding, injection molding, casting extrusion, drawing and the like. Injection molding is particularly preferred using polycarbonate. Polypropylene is particularly preferred for blow molding a pitcher of this invention.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A container adaptable for retention and delivery of a liquid containing ice, the container comprising:

a substantially planar base;

at least one wall;

an asymmetrical ice dam means for resisting pouring of said ice;

said at least one wall terminating in an upper edge parallel to said planar base, and said wall cooperating with said base to form a unitary liquid-retentive well; said well being substantially symmetrically disposed about an axial plane passing perpendicularly through said base;

a grasping means; and said asymmetrical ice dam means further comprising a major lip comprising a half dome depending inwardly and upwardly over said well from said upper edge and terminating in an inner edge, said inner edge having a downward depending strainer means; a spout projecting distally from said rim adjacent the strainer means; and a minor lip adjacent said spout, thereby forming an asymmetrical ice dam through which said liquid can flow when said container is substantially horizontal, and said ice can be controllably retained by rotating said container to move said major lip in front of the flowing ice.

2. The container of claim 1 wherein said upper edge further comprises a circle.

3. The container of claim 1 wherein said minor lip further comprises an inward and upward curvature from said rim.

4. The container of claim 1 wherein said grasping means further comprises a handle located substantially between 70° and 180° from said spout.

5. The container of claim 1 wherein said downward depending strainer means further comprises a length of approximately $2\frac{1}{4}$ inches.

6. The container of claim 5 wherein said downward depending strainer further comprises a plurality of slots.

7. The container of claim 6 wherein said downward depending strainer further comprises approximately a 5° angle away from the half dome.

8. The container of claim 2 wherein said half dome further comprises a dimension substantially one half the area defined by said circle.

9. A container adaptable for retention and delivery of a liquid containing ice, the container comprising:

a substantially planar base;

at least one wall;

an asymmetrical ice dam means for resisting pouring of said ice;

said at least one wall terminating in a circular upper edge parallel to said base and cooperating with said base to form a unitary liquid-retentive well; said well being substantially symmetrically disposed about an axial plane passing perpendicularly through said base;

said asymmetrical ice dam means comprising a major lip comprising a semi-circular skirt depending inwardly and upwardly over said well from said upper edge and terminating in an inner edge, and a strainer means depending therefrom, and a minor lip;

a spout projecting outwards from said upper edge between said major and minor lips; and said wall further comprising grasping means, whereby rotating said container when said container is substantially horizontal causes said major lip to retain said ice in a controllable manner ranging from no ice to a moderate amount of ice to a rush of ice.

10. The container of claim 9 wherein said grasping means further comprises a handle located substantially between 70° and 180° from said spout.

11. The container of claim 9 wherein said strainer means further comprises a downward extension of said semi-circular skirt which slopes in an obtuse angle therefrom into said spout.

12. The container of claim 11 wherein said strainer means further comprises slots.

13. The container of claim 9 wherein said semi-circular skirt further comprises a dimension substantially one half the area defined by said upper edge.

14. A container adaptable for retention and delivery of a liquid containing solid particles, the container comprising:

a substantially planar base;

at least one wall;

an asymmetrical dam means for resisting pouring of said solid particles;

said at least one wall terminating in a circular upper edge parallel to said base and cooperating with said base to form a unitary liquid-retentive well; said well being substantially symmetrically disposed about an axial plane passing perpendicularly through said base;

said asymmetrical dam means further comprising a major lip comprising a semi-circular skirt depending inwardly and upwardly over said well from said upper edge and terminating in an inner edge;

said semi-circular skirt further comprising a strainer a spout projecting outwards from said upper edge adjacent said major lip; and said wall further comprising grasping means, whereby rotating said cooking container when said container is substantially horizontal causes said major lip to retain said solid particles in a controllable manner ranging from no solid particles to a moderate amount of solid particles to a rush of solid particles.

15. The container of claim 14 wherein said grasping means further comprises a handle located substantially between 70° and 180° from said spout.

16. The container of claim 14 wherein said strainer means further comprises slots which slope into said spout.

17. The container of claim 16 wherein said slope further comprises an obtuse angle relative to said semi-circular skirt.

18. The container of claim 14 wherein said major lip further comprises a dimension ranging from one third to one half the area defined by said circular upper edge.

19. The container of claim 18 further comprising a lid fitting into said area between said circular upper edge and said major lip.

20. The container of claim 14 further comprising a minor lip opposite said spout from said strainer means.

* * * * *